US008867943B2

(12) United States Patent
Ishigaya et al.

(10) Patent No.: US 8,867,943 B2
(45) Date of Patent: Oct. 21, 2014

(54) FIXING DEVICE AND IMAGE FORMING APPARATUS INCORPORATING SAME

(75) Inventors: Yasunori Ishigaya, Kanagawa (JP); Masahiro Samei, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 360 days.

(21) Appl. No.: 13/109,346

(22) Filed: May 17, 2011

(65) Prior Publication Data

US 2011/0299899 A1 Dec. 8, 2011

(30) Foreign Application Priority Data

Jun. 8, 2010 (JP) ..... 2010-130760

(51) Int. Cl.
*G03G 15/20* (2006.01)

(52) U.S. Cl.
CPC ..... *G03G 15/205* (2013.01); *G03G 2215/2035* (2013.01)
USPC ..... 399/69; 399/333

(58) Field of Classification Search
CPC ..... G03G 15/205; G03G 2215/2035
USPC ..... 399/67, 69, 122, 320, 328, 329, 330, 399/331, 333, 334, 335, 123; 219/216, 619, 219/469, 670, 663
See application file for complete search history.

(56) References Cited

U.S. PATENT DOCUMENTS 5,745,833 A * 4/1998 Abe et al. ..... 399/330
6,047,158 A * 4/2000 Morigami et al. ..... 399/328
7,912,392 B2 3/2011 Yoshinaga et al.
2004/0136761 A1* 7/2004 Asakura et al. ..... 399/328
2005/0286938 A1* 12/2005 Aze et al. ..... 399/328
2009/0060550 A1* 3/2009 Seo ..... 399/69
2009/0169232 A1 7/2009 Kunii et al.
2009/0290916 A1* 11/2009 Baba ..... 399/329
2010/0061754 A1 3/2010 Ishigaya et al.
2010/0092220 A1 4/2010 Hasegawa et al.

(Continued)

FOREIGN PATENT DOCUMENTS

JP 3527442 2/2004
JP 2005-148350 6/2005

(Continued)

OTHER PUBLICATIONS

U.S. Appl. No. 12/929,325, filed Jan. 14, 2011.

(Continued)

*Primary Examiner* — Benjamin Schmitt
*Assistant Examiner* — Matthew Miller
(74) *Attorney, Agent, or Firm* — Oblon, Spivak, McClelland, Maier & Neustadt, L.L.P.

(57) ABSTRACT

A fixing device includes a fixing rotary body inside which a heat generator is disposed and an exciting coil unit disposed opposite the heat generator via the fixing rotary body. A first moving mechanism is connected to one of the heat generator and the exciting coil unit to move the one of the heat generator and the exciting coil unit between a first position where the exciting coil unit is disposed away from the heat generator and a second position where the exciting coil unit is disposed closer to the heat generator. The exciting coil unit heats a first heat generation layer of the fixing rotary body at the first position, and heats both the first heat generation layer of the fixing rotary body and a second heat generation layer of the heat generator at the second position.

22 Claims, 8 Drawing Sheets

(56) References Cited

U.S. PATENT DOCUMENTS

| | | | | |
|---|---|---|---|---|
| 2010/0092221 | A1 | 4/2010 | Shinshi et al. | |
| 2010/0178088 | A1 * | 7/2010 | Koshida et al. | 399/328 |
| 2011/0064437 | A1 | 3/2011 | Yamashina et al. | |
| 2011/0091226 | A1 | 4/2011 | Ishigaya et al. | |

FOREIGN PATENT DOCUMENTS

| | | |
|---|---|---|
| JP | 2006-71960 | 3/2006 |
| JP | 3900692 | 1/2007 |
| JP | 3926551 | 3/2007 |
| JP | 2009-282413 | 12/2009 |
| JP | 2010-32699 | 2/2010 |

OTHER PUBLICATIONS

U.S. Appl. No. 13/064,107, filed Mar. 7, 2011.

* cited by examiner

FIXING DEVICE AND IMAGE FORMING APPARATUS INCORPORATING SAME

CROSS-REFERENCE TO RELATED APPLICATIONS

The present application is based on and claims priority to Japanese Patent Application No. 2010-130760, filed on Jun. 8, 2010, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing belt, formed into a loop, to apply heat to the recording medium bearing the toner image, and a pressing roller, disposed opposite the fixing belt, to apply pressure to the recording medium. A stationary, nip formation pad disposed inside the loop formed by the fixing belt is pressed against the pressing roller disposed outside the loop formed by the fixing belt via the fixing belt to form a nip between the fixing belt and the pressing roller through which the recording medium bearing the toner image passes. As the fixing belt and the pressing roller rotate and convey the recording medium through the nip, they apply heat and pressure to the recording medium to fix the toner image on the recording medium.

As a mechanism that heats the fixing belt, the fixing device may include an exciting coil disposed opposite the fixing belt, which generates a magnetic flux toward the fixing belt, thus heating a heat generation layer of the fixing belt by electromagnetic induction.

For example, Japanese publication No. JP2009-282413 proposes a configuration in which a temperature-sensitive magnetic member, which generates heat by a magnetic flux generated by the exciting coil, separably contacts the inner circumferential surface of the fixing belt. Before the fixing belt is heated to a desired fixing temperature, the temperature-sensitive magnetic member is isolated from the fixing belt; therefore it does not draw heat from the fixing belt, shortening a warm-up time of the fixing belt. Conversely, after the fixing belt has been heated to the desired fixing temperature, the temperature-sensitive magnetic member contacts the fixing belt to conduct heat thereto supplementarily, thus maintaining the fixing temperature of the fixing belt.

However, such configuration has a drawback in that, even when the temperature-sensitive magnetic member is isolated from the fixing belt during warm-up, it is still heated by the magnetic flux generated by the exciting coil. That is, the magnetic flux is not concentrated solely on the fixing belt, thereby degrading heating efficiency for heating the fixing belt.

As another example, Japanese patent No. 3,527,442 proposes a configuration in which a conductive member is rotatably disposed inside a heating roller in such a manner that it is moved between the two positions: a first position where it is disposed opposite an exciting coil disposed outside the heating roller, and a second position where it is not disposed opposite the exciting coil. With this configuration, before the heating roller is heated to a desired fixing temperature, the conductive member is at the second position where it is not disposed opposite the exciting coil so that a magnetic flux generated by the exciting coil is concentrated solely on the heating roller, not reaching the conductive member. By contrast, after the heating roller has been heated to the desired fixing temperature, the conductive member is moved to the first position where it is disposed opposite the exciting coil.

However, such configuration also has a drawback in that the heating roller is constructed of a heat generation layer heated by the magnetic flux generated by the exciting coil and a temperature-sensitive magnetic layer, which prevents overheating of the heating roller, combined with the heat generation layer. Since the temperature-sensitive magnetic layer is combined with the heat generation layer, it draws heat from the heat generation layer, lengthening a warm-up time of the heating roller.

BRIEF SUMMARY OF THE INVENTION

This specification describes below an improved fixing device. In one exemplary embodiment of the present invention, the fixing device includes an endless belt-shaped fixing rotary body including a first heat generation layer; a pressing rotary body disposed opposite the fixing rotary body to form a nip therebetween through which a recording medium bearing a toner image passes; a heat generator disposed opposite the fixing rotary body and including a second heat generation layer to heat the fixing rotary body; an exciting coil unit disposed opposite the heat generator via the fixing rotary body to generate a magnetic flux; and a first moving mechanism connected to one of the heat generator and the exciting coil unit to move the one of the heat generator and the exciting coil unit between a first position where the exciting coil unit is disposed away from the heat generator and a second position where the exciting coil unit is disposed closer to the heat generator. The exciting coil unit heats the first heat generation layer of the fixing rotary body by the magnetic flux at the first position, and heats both the first heat generation layer of the fixing rotary body and the second heat generation layer of the heat generator by the magnetic flux at the second position.

This specification further describes below an improved fixing device. In one exemplary embodiment of the present invention, the fixing device includes an endless belt-shaped fixing rotary body including a first heat generation layer; a pressing rotary body disposed opposite the fixing rotary body to form a nip therebetween through which a recording medium bearing a toner image passes; a heat generator to separably contact the fixing rotary body and including a second heat generation layer; an exciting coil unit disposed opposite the heat generator via the fixing rotary body to generate a magnetic flux; and a second moving mechanism connected to one of the heat generator and the exciting coil unit to move the one of the heat generator and the exciting coil unit between a non-opposed position where the heat generator is not disposed opposite the exciting coil unit and an opposed position where the heat generator is disposed opposite the exciting coil unit. The exciting coil unit heats the first heat generation layer of the fixing rotary body by the magnetic flux at the non-opposed position, and heats both the first heat generation layer of the fixing rotary body and the second heat generation layer of the heat generator by the magnetic flux at the opposed position.

This specification further describes below an improved fixing device. In one exemplary embodiment of the present invention, the fixing device includes an endless belt-shaped fixing rotary body including a first heat generation layer; a pressing rotary body disposed opposite the fixing rotary body to form a nip therebetween through which a recording medium bearing a toner image passes, the pressing rotary body including a second heat generation layer; an exciting coil unit disposed opposite the pressing rotary body via the fixing rotary body to generate a magnetic flux; and a coil moving mechanism connected to the exciting coil unit to move the exciting coil unit between a first position where the exciting coil unit is disposed away from the pressing rotary body and a second position where the exciting coil unit is disposed closer to the pressing rotary body. The exciting coil unit heats the first heat generation layer of the fixing rotary body by the magnetic flux at the first position, and heats both the first heat generation layer of the fixing rotary body and the second heat generation layer of the pressing rotary body by the magnetic flux at the second position.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
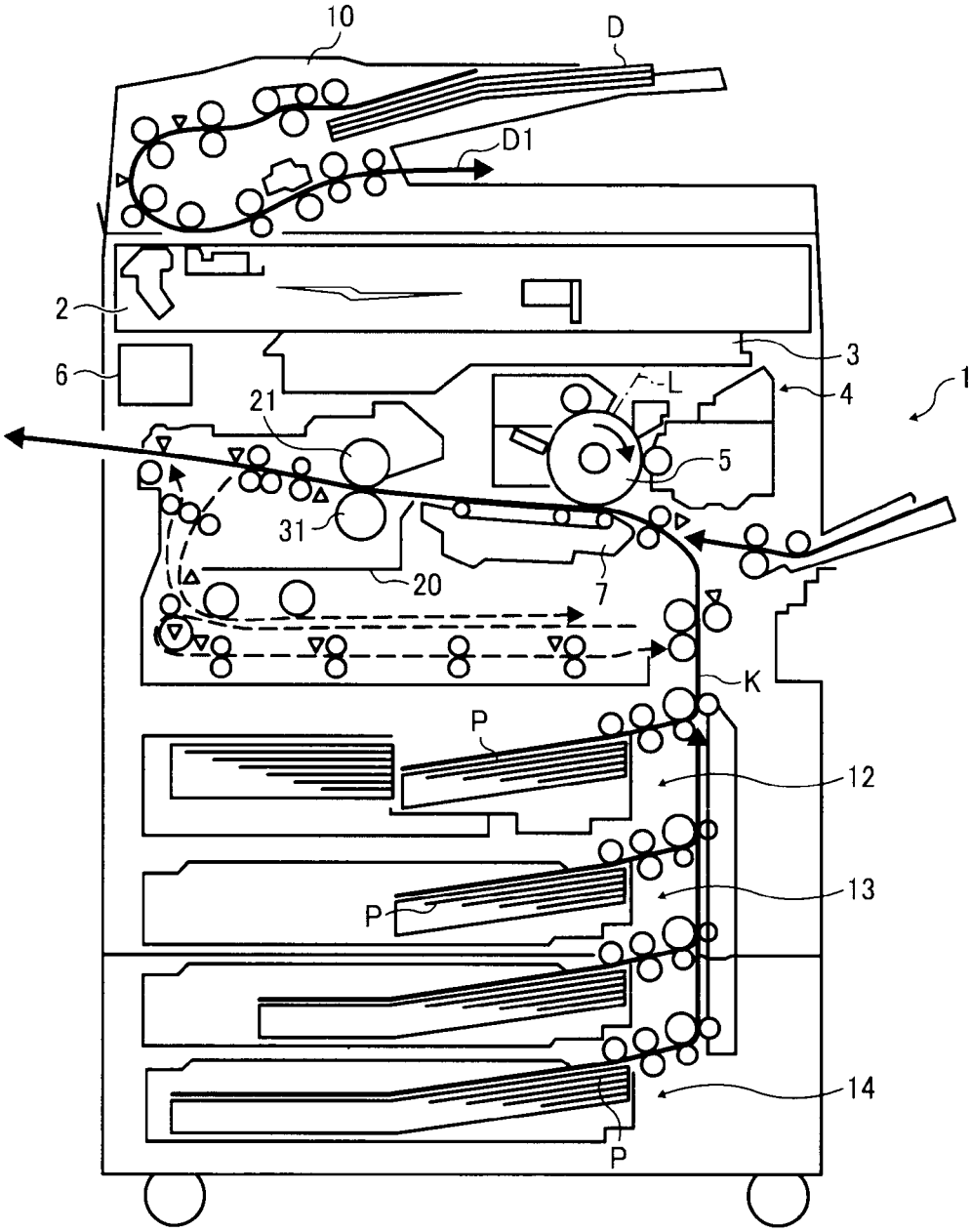
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image foaming apparatus 1 is a copier for forming an image on a recording medium.

Referring to FIG. 1, the following describes the structure of the image forming apparatus 1.

As illustrated in FIG. 1, the image forming apparatus 1 includes an auto document feeder 10, disposed atop the image forming apparatus 1, which feeds an original document D bearing an original image placed thereon to an original document reader 2 disposed below the auto document feeder 10. The original document reader 2 optically reads the original image on the original document D to generate image data and sends it to an exposure device 3 disposed below the original document reader 2. The exposure device 3 emits light L onto a photoconductive drum 5 of an image forming device 4 disposed below the exposure device 3 according to the image data sent from the original document reader 2 to form an electrostatic latent image on the photoconductive drum 5. Thereafter, the image forming device 4 renders the electrostatic latent image formed on the photoconductive drum 5 visible as a toner image with developer (e.g., toner).

Below the image forming device 4 is a transfer device 7 that transfers the toner image formed on the photoconductive drum 5 onto a recording medium P sent from one of paper trays 12, 13, and 14, each of which loads a plurality of recording media P (e.g., transfer sheets), disposed in a lower portion of the image forming apparatus 1 below the transfer device 7. The recording medium P bearing the transferred toner image is sent to a fixing device 20 disposed downstream from the transfer device 7 in a recording medium conveyance direction, where a fixing belt 21 and a pressing roller 31 disposed opposite each other apply heat and pressure to the recording medium P, thus fixing the toner image on the recording medium P.

Referring to FIG. 1, the following describes the operation of the image forming apparatus 1 having the above-described structure.

An original document D bearing an original image, placed on an original document tray of the auto document feeder 10 by a user, is conveyed by a plurality of conveyance rollers of the auto document feeder 10 in a direction D1 above the original document reader 2. As the original document D passes over an exposure glass of the original document reader 2, the original document reader 2 optically reads the original image on the original document D to generate image data.

The image data is converted into an electric signal and then sent to the exposure device 3. The exposure device 3, serving as an image writer, emits light L (e.g., a laser beam) onto the photoconductive drum 5 of the image forming device 4 according to the electric signal, thus writing an electrostatic latent image on the photoconductive drum 5.

The image forming device 4 performs a plurality of image forming processes as the photoconductive drum 5 rotates clockwise in FIG. 1: a charging process, an exposure process, and a development process. In the charging process, a charger of the image forming device 4 charges an outer circumferential surface of the photoconductive drum 5, accordingly the exposure device 3 emits light L onto the charged outer circumferential surface of the photoconductive drum 5 to form an electrostatic latent image thereon as described above in the exposure process. Thereafter, in the development process, a development device of the image forming device 4 develops the electrostatic latent image formed on the photoconductive drum 5 into a toner image with toner.

On the other hand, a recording medium P is sent to a transfer nip formed between the photoconductive drum 5 and the transfer device 7 from one of the plurality of paper trays 12, 13, and 14, which is selected manually by the user using a control panel disposed atop the image forming apparatus 1 or automatically by an electric signal of a print request sent from a client computer. If the paper tray 12 is selected, for example, an uppermost recording medium P of a plurality of recording media P loaded in the paper tray 12 is conveyed to a registration roller pair disposed in a conveyance path K extending from each of the paper trays 12, 13, and 14 to the transfer device 7.

When the uppermost recording medium P reaches the registration roller pair, it is stopped by the registration roller pair temporarily and then conveyed to the transfer nip formed between the photoconductive drum 5 and the transfer device 7 at a time when the toner image formed on the photoconductive drum 5 is transferred onto the uppermost recording medium P by the transfer device 7.

After the transfer of the toner image onto the recording medium P, the recording medium P bearing the toner image is sent to the fixing device 20 through a conveyance path extending from the transfer device 7 to the fixing device 20. As the recording medium P passes through a fixing nip formed between the fixing belt 21 and the pressing roller 31 of the fixing device 20, it receives heat from the fixing belt 21 and pressure from the fixing belt 21 and the pressing roller 31, which fix the toner image on the recording medium P. Thereafter, the recording medium P bearing the fixed toner image is discharged to an outside of the image forming apparatus 1, thus completing a series of image forming processes.

Referring to FIGS. 2, 3A, 3B, 4A, and 4B, the following describes the structure and operation of the fixing device 20 installed in the image forming apparatus 1 described above.

Figure 2:
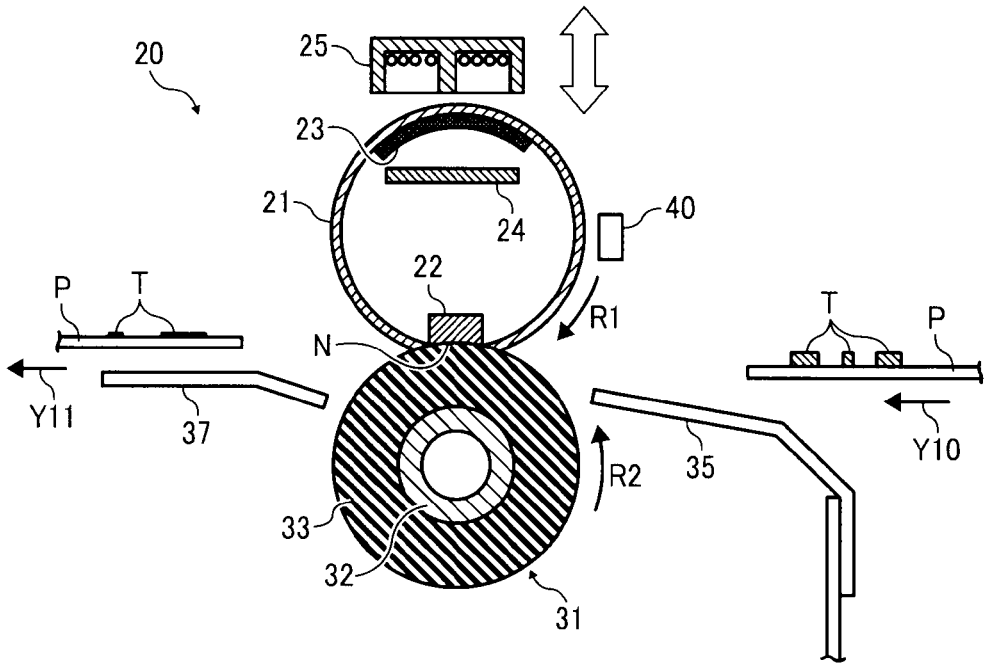
FIG. 2 is a vertical sectional view of a fixing device included in the image forming apparatus shown in FIG. 1.
Figure 3A:
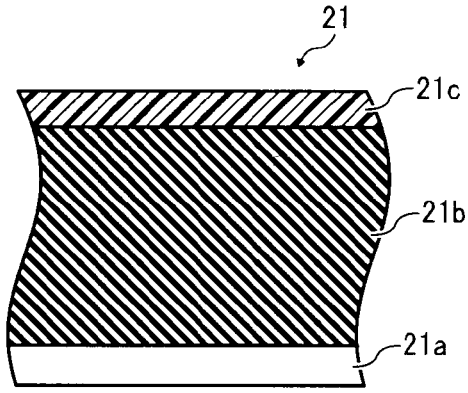
FIG. 3A is a partial vertical sectional view of a fixing belt included in the fixing device shown in FIG. 2.
Figure 3B:
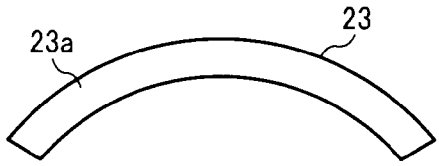
FIG. 3B is a vertical sectional view of a heat generator included in the fixing device shown in FIG. 2.
Figure 4A:
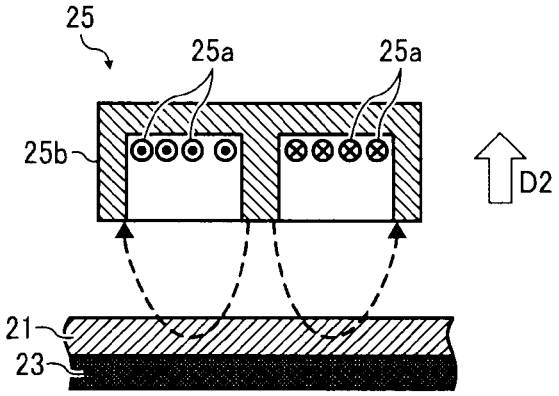
FIG. 4A is a partially enlarged vertical sectional view of the fixing belt, the heat generator, and an exciting coil unit included in the fixing device shown in FIG. 2.
Figure 4B:
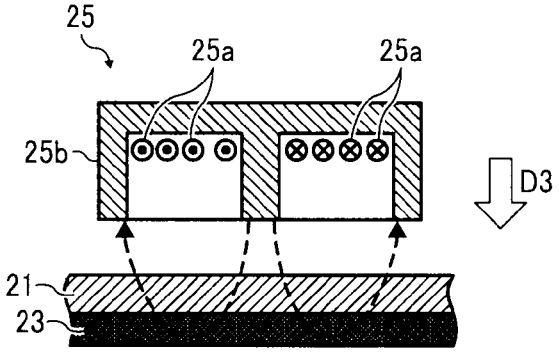
FIG. 4B is a partially enlarged vertical sectional view of the fixing belt, the heat generator, and the exciting coil unit shown in FIG. 4A in a state in which the exiting coil unit is disposed closer to the fixing belt.

FIG. 2 is a vertical sectional view of the fixing device 20. FIG. 3A is a partial vertical sectional view of the fixing belt 21 of the fixing device 20. FIG. 3B is a vertical sectional view of a heat generator 23 of the fixing device 20. FIG. 4A is a partially enlarged vertical sectional view of the fixing belt 21, the heat generator 23, and an exciting coil unit 25 of the fixing device 20. FIG. 4B is a partially enlarged vertical sectional view of the fixing belt 21, the heat generator 23, and the exciting coil unit 25 in a state in which the exiting coil unit 25 is disposed closer to the fixing belt 21.

As illustrated in FIG. 2, the fixing device 20 includes the fixing belt 21 formed into a loop; a nip formation pad 22, the heat generator 23, and a shield 24, which are disposed inside the loop formed by the fixing belt 21; and the exciting coil unit 25, the pressing roller 31, a temperature sensor 40, and guides 35 and 37, which are disposed outside the loop formed by the fixing belt 21.

The fixing belt 21 is a flexible, thin endless belt serving as a fixing member or a fixing rotary body that rotates or moves clockwise in FIG. 2 in a rotation direction R1. As illustrated in FIG. 3A, the fixing belt 21, having a thickness not greater than about 1 mm, is constructed of multiple layers: a first heat generation layer 21*a* as a base layer; an elastic layer 21*b* disposed on the first heat generation layer 21*a*; and a release layer 21*c* disposed on the elastic layer 21*b*.

For example, the first heat generation layer 21*a* constitutes an inner circumferential surface of the fixing belt 21, that is, a contact face sliding over the nip formation pad 22 and the heat generator 23 disposed inside the loop formed by the fixing belt 21. The first heat generation layer 21*a*, made of a conductive material having a relatively low heat capacity, has a thickness in a range of from about several microns to about several hundred microns, preferably in a range of from about ten microns to about several tens of microns, thus serving as a heat generation layer heated by the exciting coil unit 25 by electromagnetic induction.

The elastic layer 21*b*, made of a rubber material such as silicon rubber, silicon rubber foam, and/or fluorocarbon rubber, has a thickness in a range of from about 100 μm to about 300 μm. The elastic layer 21*b* eliminates or reduces slight surface asperities of the fixing belt 21 at a nip N formed between the fixing belt 21 and the pressing roller 31. Accordingly, heat is uniformly transmitted from the fixing belt 21 to a toner image T on a recording medium P passing through the nip N, minimizing formation of a rough image such as an orange peel image. According to this exemplary embodiment, silicon rubber with a thickness of about 200 μm is used as the elastic layer 21*b*.

The release layer 21*c* has a thickness in a range of from about 10 μm to about 50 μm, and is made of tetrafluoroethylene-perfluoroalkylvinylether copolymer (PFA), polytetrafluoroethylene (PTFE), polyimide, polyetherimide, and/or polyether sulfide (PES). The release layer 21*c* releases or separates the toner image T from the fixing belt 21.

Inside the loop formed by the fixing belt 21 are disposed the nip formation pad 22, the heat generator 23, and the shield 24. Outside the loop formed by the fixing belt 21 is the exciting coil unit 25 disposed opposite the fixing belt 21 with a predetermined gap between the exciting coil unit 25 and a part of an outer circumferential surface of the fixing belt 21. The inner circumferential surface of the fixing belt 21 is applied with a lubricant that reduces friction between an outer circumferential surface of the nip formation pad 22 and the heat generator 23 and the inner circumferential surface of the fixing belt 21 sliding over the nip formation pad 22 and the heat generator 23.

The nip formation pad 22 contacting the inner circumferential surface of the fixing belt 21 is a stationary member fixedly disposed inside the loop formed by the fixing belt 21; thus, the rotating fixing belt 21 slides over the stationary, nip formation pad 22. Further, the nip formation pad 22 presses against the pressing roller 31 via the fixing belt 21 to form the nip N between the fixing belt 21 and the pressing roller 31 through which the recording medium P bearing the toner image T passes. Lateral ends of the nip formation pad 22 in a longitudinal direction thereof parallel to an axial direction of the fixing belt 21 are mounted on and supported by side plates of the fixing device 20, respectively. The nip formation pad 22 is made of a rigid material that prevents substantial bending of the nip formation pad 22 by pressure applied from the pressing roller 31.

The nip formation pad 22 constitutes an opposed face (e.g., a contact face that contacts the inner circumferential surface of the fixing belt 21 sliding over the nip formation pad 22) facing the pressing roller 31 and having a concave shape corresponding to the curvature of the pressing roller 31. The recording medium P moves along the concave, opposed face of the nip formation pad 22 corresponding to the curvature of the pressing roller 31 and is discharged from the nip N in a direction Y11. Thus, the concave shape of the nip formation pad 22 prevents the recording medium P bearing the fixed toner image T from adhering to the fixing belt 21, thereby facilitating separation of the recording medium P from the fixing belt 21.

As described above, according to this exemplary embodiment, the nip formation pad 22 has a concave shape to form the concave nip N. Alternatively, however, the nip formation pad 22 may have a flat, planar shape to form a planar nip N. Specifically, the opposed face of the nip formation pad 22 disposed opposite the pressing roller 31 may have a flat, planar shape. Accordingly, the planar nip N formed by the planar opposed face of the nip formation pad 22 is substantially parallel to an imaged side of the recording medium P. Consequently, the fixing belt 21 pressed by the planar opposed face of the nip formation pad 22 is precisely adhered to the recording medium P to improve fixing performance. Further, the increased curvature of the fixing belt 21 at an exit of the nip N facilitates separation of the recording medium P discharged from the nip N from the fixing belt 21.

As illustrated in FIG. 2, the heat generator 23, contacting the inner circumferential surface of the fixing belt 21, is disposed opposite the exciting coil unit 25 via the fixing belt 21. Lateral ends of the heat generator 23 in a longitudinal direction thereof parallel to the axial direction of the fixing belt 21 are mounted on and supported by the side plates of the fixing device 20, respectively.

As illustrated in FIG. 3B, the heat generator 23 is constructed of a single layer, a second heat generation layer 23*a*. The second heat generation layer 23*a* is heated by the exciting coil unit 25 (depicted in FIG. 2) serving as an induction heater that heats the second heat generation layer 23*a* by electromagnetic induction. Specifically, the exciting coil unit 25 generates an alternating magnetic field that heats the second heat generation layer 23*a* of the heat generator 23 by electromagnetic induction, which in turn heats the fixing belt 21. In other words, the exciting coil unit 25 heats the heat generator 23 directly by electromagnetic induction and at the same time heats the fixing belt 21 indirectly via the heat generator 23.

As described above, since the fixing belt 21 has the first heat generation layer 21*a*, the alternating magnetic field generated by the exciting coil unit 25 also heats the first heat generation layer 21*a* by electromagnetic induction. In other words, the fixing belt 21 is heated by the exciting coil unit 25 directly by electromagnetic induction and at the same time is heated by the heat generator 23, which is heated by the exciting coil unit 25 by electromagnetic induction, indirectly, resulting in improved heating efficiency for heating the fixing belt 21. Thus, the heated fixing belt 21 heats the toner image T on the recording medium P passing through the nip N formed between the fixing belt 21 and the pressing roller 31.

The temperature sensor 40 (e.g., a thermistor or a thermopile), disposed opposite the outer circumferential surface of the fixing belt 21, serves as a temperature detector that detects a temperature of the outer circumferential surface of the fixing belt 21. Based on the temperature detected by the temperature sensor 40, a controller 6 depicted in FIG. 1, that is, a central processing unit (CPU) provided with a random-access memory (RAM) and a read-only memory (ROM), for example, controls output of the exciting coil unit 25, thus adjusting the temperature of the fixing belt 21 to a desired fixing temperature.

As illustrated in FIGS. 4A and 4B, the exciting coil unit 25 includes an exciting coil 25*a* and a coil core 25*b*. The exciting coil 25*a*, extending in a longitudinal direction of the exciting coil unit 25 parallel to the axial direction of the fixing belt 21, is constructed of litz wire formed by bundling thin wire and wound around the coil core 25*b* that covers a part of the outer circumferential surface of the fixing belt 21. The coil core 25*b*, made of ferromagnet (e.g., ferrite) having a relative permeability of about 2,500, generates a magnetic flux toward the first heat generation layer 21*a* depicted in FIG. 3A of the fixing belt 21 and the second heat generation layer 23*a* depicted in FIG. 3B of the heat generator 23 efficiently.

As illustrated in FIG. 2, the shield 24, disposed opposite the exciting coil unit 25 via the heat generator 23 and the fixing belt 21, is a plate made of a non-magnetic metal material such as aluminum and/or copper which shields the magnetic flux generated by the exciting coil unit 25. Thus, even when the magnetic flux generated by the exciting coil unit 25 penetrates the fixing belt 21 and the heat generator 23, the shield 24 generates an eddy current that offsets the penetrating magnetic flux, reducing leakage of the magnetic flux from the fixing belt 21 and the heat generator 23 for improved heating efficiency for heating the fixing belt 21.

As illustrated in FIG. 2, the pressing roller 31 serves as a pressing rotary body that presses against the outer circumferential surface of the fixing belt 21 at the nip N. The pressing roller 31 is constructed of a hollow metal core 32 and an elastic layer 33 disposed on the metal core 32. The elastic layer 33, having a thickness of about 3 mm, is made of silicon rubber foam, silicon rubber, and/or fluorocarbon rubber. Optionally, a thin surface release layer made of PFA and/or PTFE may be disposed on the elastic layer 33. The pressing roller 31 is pressed against the nip formation pad 22 via the fixing belt 21 to form the desired nip N between the pressing roller 31 and the fixing belt 21.

On the pressing roller 31 is mounted a gear engaging a driving gear of a driving mechanism that drives and rotates the pressing roller 31 counterclockwise in FIG. 2 in a rotation direction R2 counter to the rotation direction R1 of the fixing belt 21. Lateral ends of the pressing roller 31 in a longitudinal direction, that is, an axial direction thereof, are rotatably supported by the side plates of the fixing device 20 via bearings, respectively. Optionally, a heat source, such as a halogen heater, may be disposed inside the pressing roller 31.

With the elastic layer 33 of the pressing roller 31 made of a sponge material such as silicon rubber foam, the pressing roller 31 applies decreased pressure to the nip formation pad 22 via the fixing belt 21 at the nip N to decrease bending of the nip formation pad 22. Further, the pressing roller 31 provides increased heat insulation that minimizes heat transmission thereto from the fixing belt 21, improving heating efficiency of the fixing belt 21.

As a mechanism to convey the recording medium P bearing the toner image T to and from the nip N formed between the fixing belt 21 and the pressing roller 31, the fixing device 20 includes two guide plates, the guide 35 disposed at an entry to the nip N and the guide 37 disposed at an exit of the nip N. The guide 35 is directed to the entry to the nip N to guide the recording medium P conveyed in a direction Y10 from the transfer device 7 depicted in FIG. 1 to the nip N. The guide 37 is directed to a conveyance path downstream from the fixing device 20 in the recording medium conveyance direction to guide the recording medium P discharged from the nip N in the direction Y11 to the conveyance path. Both the guides 35 and 37 are mounted on a frame (e.g., a body) of the fixing device 20.

Referring to FIGS. 1, 2, and 4A, the following describes the operation of the fixing device 20 having the above-described structure.

When the image forming apparatus 1 is powered on, a high-frequency power source supplies an alternating current to the exciting coil 25*a* of the exciting coil unit 25, and at the same time the pressing roller 31 starts rotating in the rotation direction R2. Accordingly, the fixing belt 21 rotates in accordance with rotation of the pressing roller 31 in the rotation direction R1 counter to the rotation direction R2 of the pressing roller 31 due to friction therebetween at the nip N.

Thereafter, at the transfer nip formed between the photoconductive drum 5 and the transfer device 7, the toner image T formed on the photoconductive drum 5 as described above is transferred onto a recording medium P sent from one of the paper trays 12, 13, and 14. Being guided by the guide 35, the recording medium P bearing the toner image T is conveyed from the transfer nip in the direction Y10 toward the nip N, entering the nip N formed between the fixing belt 21 and the pressing roller 31 pressed against each other.

As the recording medium P bearing the toner image T passes through the nip N, it receives heat from the fixing belt 21 and pressure from the fixing belt 21, the nip formation pad 22, and the pressing roller 31 that form the nip N. Thus, the toner image T is fixed on the recording medium P by the heat and the pressure applied at the nip N. Thereafter, the recording medium P bearing the fixed toner image T is discharged from the nip N and conveyed in the direction Y11 as guided by the guide 37.

Referring to FIGS. 2, 3A, 3B, 4A, 4B, and 5, the following describes the configuration of the fixing device 20 according to a first illustrative embodiment of the present invention.

Figure 5:
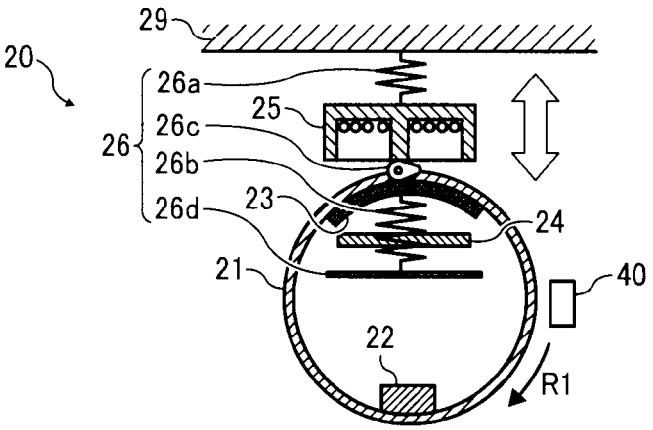
FIG. 5 is a partial vertical sectional view of the fixing device shown in FIG. 2 illustrating a coil moving mechanism included therein.

FIG. 5 is a partial vertical sectional view of the fixing device 20 showing a coil moving mechanism 26 that moves the exciting coil unit 25. The coil moving mechanism 26 moves the exciting coil unit 25 vertically in the two directions, an upward direction D2 in FIG. 4A and a downward direction D3 in FIG. 4B. That is, the coil moving mechanism 26 serves as a diametrical moving mechanism or a first moving mechanism that moves the exciting coil unit 25 bidirectionally in a diametrical direction of the fixing belt 21.

Referring to FIG. 5, a detailed description is now given of the coil moving mechanism 26.

The coil moving mechanism 26 includes a spring 26*a* attached to the exciting coil unit 25 and a frame 29 of the fixing device 20; a support 26*d* disposed inside the fixing belt 21; a spring 26*b* attached to the heat generator 23 and the support 26*d*; and a cam 26*c* contacting the exciting coil unit 25 and the heat generator 23.

The cam 26*c* is rotatably mounted on each of flanges provided on lateral ends of the fixing belt 21 in the axial direction thereof. When the cam 26*c* rotates counterclockwise in FIG. 5, it lifts the exciting coil unit 25 against a bias applied by the spring 26*a* to the exciting coil unit 25; thus the exciting coil unit 25 moves in the upward direction D2 to the first position shown in FIG. 4A. Conversely, when the cam 26*c* rotates clockwise in FIG. 5 from the first position shown in FIG. 4A, it lowers the exciting coil unit 25; thus the exciting coil unit 25 moves in the downward direction D3 to the second position shown in FIG. 4B.

With this configuration, the coil moving mechanism 26 moves the exciting coil unit 25 between the first position shown in FIG. 4A and the second position shown in FIG. 4B: the first position where the exciting coil unit 25 is disposed away from the fixing belt 21; the second position where the exciting coil unit 25 is disposed closer to the fixing belt 21. At the first position, the exciting coil unit 25 heats only the first heat generation layer 21*a* depicted in FIG. 3A of the fixing belt 21 by electromagnetic induction, which is hereinafter referred to as a first heating state. By contrast, at the second position, the exciting coil unit 25 heats both the first heat generation layer 21*a* of the fixing belt 21 and the second heat generation layer 23*a* depicted in FIG. 3B of the heat generator 23, thus heating the fixing belt 21 directly with the first heat generation layer 21*a* installed therein and indirectly with the second heat generation layer 23*a* of the heat generator 23 by electromagnetic induction, which is hereinafter referred to as a second heating state. That is, the coil moving mechanism 26 moves the exciting coil unit 25 bidirectionally in the directions D2 and D3 to change a distance between the exciting coil unit 25 and the heat generator 23 disposed opposite each other, thus switching between the first heating state and the second heating state.

Specifically, as illustrated in FIG. 4A, when the exciting coil unit 25 is at the first position where it is away from the fixing belt 21, the magnetic flux generated by the exciting coil unit 25 indicated by the broken line reaches the first heat generation layer 21*a* of the fixing belt 21 but does not reach the second heat generation layer 23*a* of the heat generator 23. Thus, only the first heat generation layer 21*a* of the fixing belt 21 generates heat by electromagnetic induction in the first heating state. Since the magnetic flux generated by the exciting coil unit 25 is concentrated on the first heat generation layer 21*a* of the fixing belt 21 only, not reaching the second heat generation layer 23*b* of the heat generator 23, the fixing belt 21 is heated quickly.

It is to be noted that, although the fixing belt 21 heats the heat generator 23 in the first heating state, the heat generator 23 contacts the fixing belt 21 at a relatively small area, that is, a part of the inner circumferential surface of the fixing belt 21, not the entire inner circumferential surface of the fixing belt 21 in a circumferential direction thereof, as illustrated in FIG. 2, and therefore has a relatively smaller heat capacity, minimizing degradation in heating efficiency for heating the fixing belt 21 due to heat transmission therefrom to the heat generator 23.

By contrast, as illustrated in FIG. 4B, when the exciting coil unit 25 is at the second position where it is disposed closer to the fixing belt 21, the magnetic flux generated by the exciting coil unit 25 indicated by the broken line penetrates the first heat generation layer 21*a* depicted in FIG. 3A of the fixing belt 21 and reaches the second heat generation layer 23*a* depicted in FIG. 3B of the heat generator 23. Thus, the exciting coil unit 25 heats the second heat generation layer 23*a* of the heat generator 23 as well as the first heat generation layer 21*a* of the fixing belt 21 by electromagnetic induction in the second heating state. Since the magnetic flux generated by the exciting coil unit 25 is diffused to the second heat generation layer 23*a* of the heat generator 23, the heat generator 23 heats the fixing belt 21 supplementarily to maintain the temperature of the fixing belt 21.

With the configuration described above for changing the distance between the exciting coil unit 25 and the heat generator 23, the fixing belt 21 can be heated in either the first heating state or the second heating state selected according to the condition of the fixing device 20 described below, improving heating efficiency for heating the fixing belt 21 by electromagnetic induction and shortening the time required to heat the fixing belt 21 to a desired fixing temperature.

For example, according to the first illustrative embodiment, the controller 6 depicted in FIG. 1 controls the coil moving mechanism 26 to switch between the first heating state and the second heating state: the first heating state when the fixing device 20 or the image forming apparatus 1 depicted in FIG. 1 is warmed up; the second heating state when the recording media P bearing the toner image T are conveyed to the nip N of the fixing device 20 continuously.

With such control, even when the fixing belt 21 is cool in the morning after the image forming apparatus 1 has been powered off for a long time, the fixing belt 21 is heated in the first heating state with a shortened warm-up time. Conversely, as a plurality of recording media P is conveyed through the nip N formed between the fixing belt 21 and the pressing roller 31 continuously, they draw heat from the fixing belt 21, decreasing the temperature of the fixing belt 21 gradually. To address this problem, the exciting coil unit 25 heats the fixing belt 21 in the second heating state to transmit heat generated by the heat generator 23 to the fixing belt 21, thus heating the fixing belt 21 supplementarily to offset the temperature decrease of the fixing belt 21 and minimizing formation of a faulty toner image due to the decreased temperature of the fixing belt 21 caused by the recording media P conveyed to the nip N continuously.

Referring to FIGS. 2, 3A, 4A, 4B, and 6, the following describes the material of the first heat generation layer 21*a* of the fixing belt 21.

The first heat generation layer 21*a* is made of a magnetic shunt metal material having ferromagnetism such as iron, nickel, cobalt, and/or alloy of these, preferably a magnetic shunt metal material having property changing from ferromagnetism to paramagnetism such as iron, nickel, silicon, boron, niobium, copper, zirconium, cobalt, and/or alloy of these.

With the first heat generation layer 21*a* made of the above-described material, when a Curie temperature of the first heat generation layer 21*a* is set to around a predetermined fixing temperature, the fixing belt 21 is not heated to above the fixing temperature. Accordingly, ripple in the temperature of the fixing belt 21 is decreased even when the plurality of recording media P is conveyed to the nip N continuously, stabilizing fixing performance and gloss application to the fixed toner image T on the recording medium P.

Further, when a Curie temperature of the first heat generation layer 21*a* is set to not greater than an upper temperature limit of the fixing belt 21, non-conveyance regions NR on the fixing belt 21, provided at lateral ends thereof in the axial direction, through which the recording media P do not pass are not overheated to above the upper temperature limit of the fixing belt 21. Accordingly, even when small recording media P, which have a small width in the axial direction of the fixing belt 21 and therefore do not pass through the non-conveyance regions NR of the fixing belt 21, are conveyed to the nip N continuously, the fixing belt 21 may not be overheated due to lack of heat transmission from the non-conveyance regions NR thereon to the small recording media P.

Figure 6:
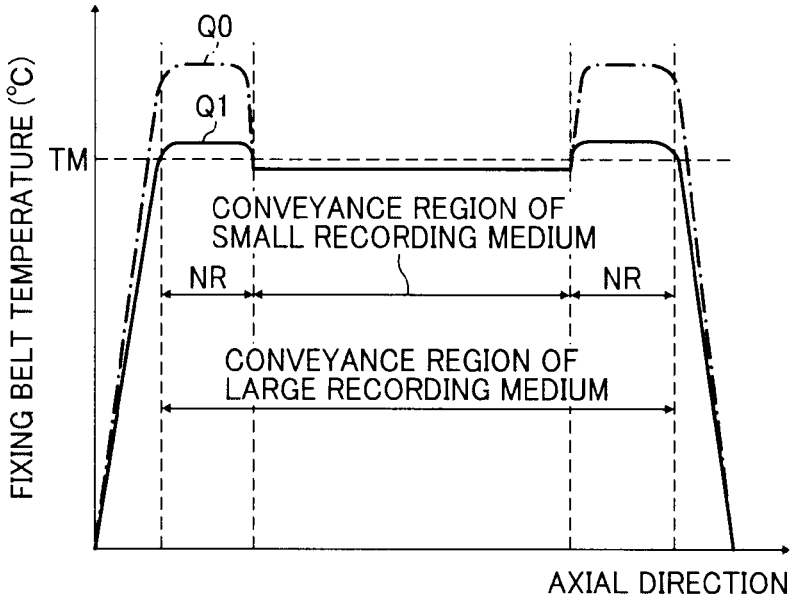
FIG. 6 is a graph illustrating a temperature distribution of the fixing belt shown in FIG. 3A in an axial direction thereof in a state in which small recording media are conveyed to the fixing belt continuously.

FIG. 6 is a graph illustrating a temperature distribution of the fixing belt 21 in the axial direction thereof when small recording media P are conveyed to the nip N continuously. The graph shows the two lines: a line Q0, that is, the alternate-long-and-short-dashed line, indicating the temperature distribution of the fixing belt 21 with the first heat generation layer 21*a* made of general metal; and a line Q1, that is, the solid line, indicating the temperature distribution of the fixing belt 21 with the first heat generation layer 21*a* made of a magnetic shunt metal material. The line Q1 shows that, with the first heat generation layer 21*a* made of the magnetic shunt metal material, the temperature of the fixing belt 21 is suppressed to around a predetermined fixing temperature TM even in the non-conveyance regions NR thereon through which small recording media P do not pass.

Alternatively, the first heat generation layer 21*a* of the fixing belt 21 may be made of a non-magnetic metal material such as gold, silver, copper, aluminum, zinc, tin, lead, bismuth, beryllium, antimony, and/or alloy of these.

With the first heat generation layer 21*a* made of the above-described alternative material, even when the distance between the exciting coil unit 25 and the fixing belt 21 disposed opposite each other changes, an amount of magnetic flux generated by the exciting coil unit 25 and penetrating the fixing belt 21 does not change substantially, minimizing variation in heating of the fixing belt 21 in the axial direction thereof. Moreover, even when the fixing belt 21 is displaced or skewed in the axial direction thereof as it rotates in the rotation direction R1, it can be heated substantially uniformly in the axial direction thereof.

Preferably, the first heat generation layer 21*a* of the fixing belt 21 has a thickness smaller than a skin depth when an alternating electric current of a predetermined frequency is applied to the exciting coil 25*a* of the exciting coil unit 25. The "skin depth" defines a value obtained based on a resistivity and a magnetic permeability of the first heat generation layer 21*a* and a frequency of the alternating electric current that excites the first heat generation layer 21*a*, that is, a value in a range of from about 20 kHz to about 100 kHz according to the first illustrative embodiment.

Thus, with the first heat generation layer 21*a* having the thickness smaller than the skin depth as described above according to the first illustrative embodiment, the magnetic flux generated by the exciting coil unit 25 precisely reaches the second heat generation layer 23*a* of the heat generator 23 in the second heating state shown in FIG. 4B.

Referring to FIGS. 2, 3B, 4A, and 4B, the following describes the material of the second heat generation layer 23*a* of the heat generator 23.

The second heat generation layer 23*a* is made of a magnetic shunt metal material having property changing from ferromagnetism to paramagnetism such as iron, nickel, silicon, boron, niobium, copper, zirconium, cobalt, and/or alloy of these.

With the second heat generation layer 23*a* made of the above-described material, when a Curie temperature of the second heat generation layer 23*a* is set to a temperature higher than the predetermined fixing temperature and not higher than the upper temperature limit of the fixing belt 21, the fixing belt 21 is not overheated. When the temperature of the second heat generation layer 23*a* exceeds the Curie temperature, the magnetic flux generated by the exciting coil unit 25 penetrates the second heat generation layer 23*a* and reaches the shield 24 made of a non-magnetic material; the shield 24 generates an eddy current that offsets the penetrating magnetic flux.

Alternatively, the second heat generation layer 23*a* of the heat generator 23 may be made of a ferromagnetic metal material such as iron, nickel, and/or cobalt.

With the second heat generation layer 23*a* made of the above-described material, even in the second heating state shown in FIG. 4B in which the exciting coil unit 25 is disposed closer to the heat generator 23, the magnetic flux generated by the exciting coil unit 25 does not penetrate the second heat generation layer 23*a* of the heat generator 23, thus improving heating efficiency for heating the heat generator 23 by electromagnetic induction even without the shield 24.

According to the first illustrative embodiment described above, the heat generator 23 is constructed of a single layer, that is, the second heat generation layer 23*a*. Alternatively, the heat generator 23 may be constructed of multiple layers: an inner surface layer serving as a heat generation layer, which generates heat by electromagnetic induction, equivalent to the second heat generation layer 23*a*; an intermediate layer made of a high-thermal conductive material such as aluminum, iron, and/or stainless steel; and an outer surface layer serving as another heat generation layer, which generates heat by electromagnetic induction, equivalent to the second heat generation layer 23*a*, for example.

Figure 7A:
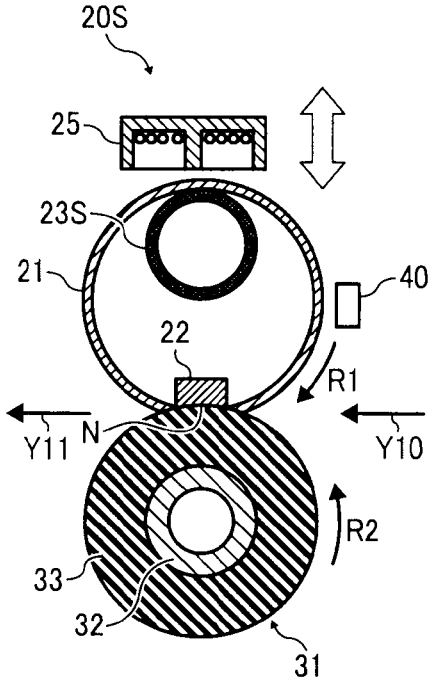
FIG. 7A is a vertical sectional view of a fixing device as a first variation of the fixing device shown in FIG. 2.
Figure 7B:
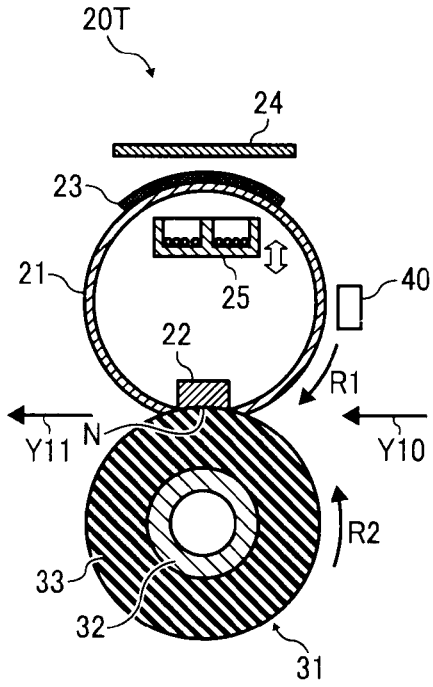
FIG. 7B is a vertical sectional view of a fixing device as a second variation of the fixing device shown in FIG. 2.

Referring to FIGS. 7A and 7B, the following describes variations of the fixing device 20 according to the first illustrative embodiment. FIG. 7A is a vertical sectional view of a fixing device 20S that employs a tubular heat generator 23S instead of the arc-shaped heat generator 23 depicted in FIG. 2 as a first variation of the fixing device 20. FIG. 7B is a vertical sectional view of a fixing device 20T that employs the heat generator 23, the shield 24, and the exciting coil unit 25 disposed at positions different from those of the fixing device 20 depicted in FIG. 2 as a second variation of the fixing device 20.

According to the first illustrative embodiment described above, the fixing device 20 employs the substantially semi-cylindrical heat generator 23 as shown in FIG. 2. Alternatively, the heat generator may be cylindrical as shown in FIG. 7A. As illustrated in FIG. 7A, the cylindrical heat generator 23S contacts the inner circumferential surface of the fixing belt 21.

Further, the heat generator may be disposed outside the loop formed by the fixing belt 21 as shown in FIG. 7B. Specifically, as illustrated in FIG. 2, the fixing device 20 according to the first illustrative embodiment employs the heat generator 23 that contacts the inner circumferential surface of the fixing belt 21 and the exciting coil unit 25 that faces the outer circumferential surface of the fixing belt 21. Alternatively, as illustrated in FIG. 7B, the heat generator 23 may contact the outer circumferential surface of the fixing belt 21; the exciting coil unit 25 may face the inner circumferential surface of the fixing belt 21; and the shield 24 may be disposed outside the loop formed by the fixing belt 21 in such a manner that the heat generator 23 is provided between the shield 24 and the fixing belt 21.

Figure 8:
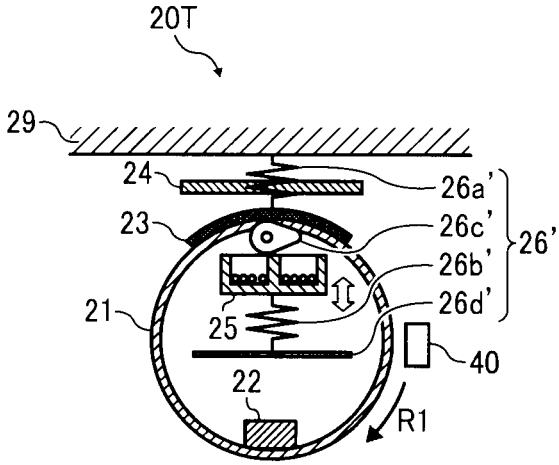
FIG. 8 is a partial vertical sectional view of the fixing device shown in FIG. 7B illustrating a coil moving mechanism included therein.

FIG. 8 is a partial vertical sectional view of the fixing device 20T showing a coil moving mechanism 26' that moves the exciting coil unit 25. The coil moving mechanism 26' moves the exciting coil unit 25 bidirectionally as shown by the two-headed arrow in FIG. 8 between the first position where the exciting coil unit 25 is disposed away from the fixing belt 21 and the second position where the exciting coil unit 25 is disposed closer to the fixing belt 21. That is, the coil moving mechanism 26' serves as a diametrical moving mechanism or a first moving mechanism that moves the exciting coil unit 25 bidirectionally in the diametrical direction of the fixing belt 21.

Referring to FIG. 8, a detailed description is now given of the coil moving mechanism 26'.

The coil moving mechanism 26' includes a spring 26*a*' attached to the heat generator 23 and the frame 29 of the fixing device 20T; a support 26*d*' disposed inside the fixing belt 21; a spring 26*b*' attached to the exciting coil unit 25 and the support 26*d*'; and a cam 26*c*' contacting the exciting coil unit 25 and the heat generator 23.

Similar to the cam 26*c* of the fixing device 20 depicted in FIG. 5, the cam 26*c*' is rotatably mounted on each of the flanges provided on the lateral ends of the fixing belt 21 in the axial direction thereof. When the cam 26*c*' rotates clockwise in FIG. 8, it lowers the exciting coil unit 25 against a bias applied by the spring 26*b*' to the exciting coil unit 25; thus the exciting coil unit 25 moves downward in FIG. 8 to the first position where the exciting coil unit 25 is disposed away from the fixing belt 21. Conversely, when the cam 26*c*' rotates counterclockwise in FIG. 8 from the first position, it lifts the exciting coil unit 25; thus the exciting coil unit 25 moves upward in FIG. 8 to the second position where the exciting coil unit 25 is disposed closer to the fixing belt 21.

As described above, with the configuration of the fixing device 20T shown in FIG. 8, the exciting coil unit 25 is moved bidirectionally as shown by the two-headed arrow in FIG. 8 between the first position where it is disposed away from the heat generator 23 in the first heating state and the second position where it is disposed closer to the heat generator 23 in the second heating state, attaining effects equivalent to the above-described effects of the fixing device 20 according to the first illustrative embodiment.

As described above, with the configuration of the fixing devices 20, 20S, and 20T shown in FIGS. 2, 7A, and 7B, respectively, it is possible to switch between the first heating state that heats the fixing belt 21 only and the second heating state that heats the fixing belt 21 directly and at the same time heats the fixing belt 21 indirectly via the heat generator 23. Specifically, the coil moving mechanisms 26 and 26' move the exciting coil unit 25 between the two positions: the first position where the exciting coil unit 25 is disposed away from the fixing belt 21, thus heating the first heat generation layer 21*a* of the fixing belt 21 only by electromagnetic induction in the first heating state; and the second position where the exciting coil unit 25 is disposed closer to the fixing belt 21, thus heating both the first heat generation layer 21*a* of the fixing belt 21 and the second heat generation layer 23*a* of the heat generator 23 by electromagnetic induction, consequently improving heating efficiency for heating the fixing belt 21 by electromagnetic induction and shortening the time to heat the fixing belt 21 to the desired fixing temperature.

According to the above-described exemplary embodiments, the exciting coil unit 25 is moved to switch between the first heating state and the second heating state. Alternatively, the heat generator 23 or both the exciting coil unit 25 and the heat generator 23 may be configured to be moved to attain effects equivalent to the effects described above.

For example, with the configuration described below in which the heat generator 23 is movable, it is isolated from the fixing belt 21 in the first heating state, contrary to the configuration shown in FIG. 4A in which the heat generator 23 contacts the fixing belt 21; therefore heat is not transmitted from the fixing belt 21 to the heat generator 23.

Referring to FIGS. 5 and 8, a detailed description is now given of the coil moving mechanisms 26 and 26' that move the heat generator 23 instead of the exciting coil unit 25.

As illustrated in FIG. 5, when the cam 26*c* rotates clockwise in FIG. 5, it lowers the heat generator 23 against a bias applied by the spring 26*b* to the heat generator 23; thus the heat generator 23 moves downward in FIG. 5 to a first position where the heat generator 23 is disposed away from the exciting coil unit 25 and isolated from the fixing belt 21. Conversely, when the cam 26*c* rotates counterclockwise in FIG. 5 from the first position, it lifts the heat generator 23; thus the heat generator 23 moves upward in FIG. 5 to a second position where the heat generator 23 is disposed closer to the exciting coil unit 25 and in contact with the fixing belt 21.

Similarly, the coil moving mechanism 26' depicted in FIG. 8 moves the heat generator 23 between the first position where the heat generator 23 is disposed away from the exciting coil unit 25 and isolated from the fixing belt 21 and the second position where the heat generator 23 is disposed closer to the exciting coil unit 25 and in contact with the fixing belt 21.

Figure 9:
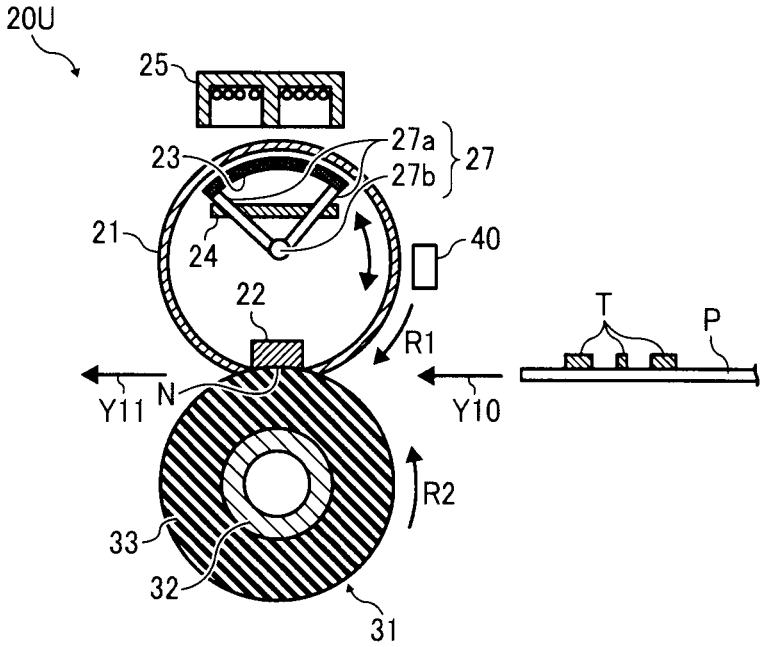
FIG. 9 is a vertical sectional view of a fixing device according to another exemplary embodiment of the present invention.
Figure 10A:
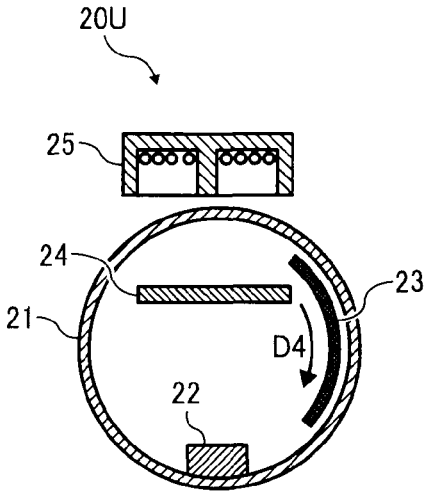
FIG. 10A is an enlarged vertical sectional view of the fixing device shown in FIG. 9 showing a heat generator included therein in a state in which the heat generator is not disposed opposite an exciting coil unit.
Figure 10B:
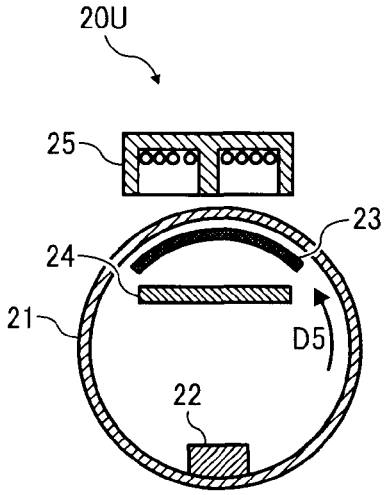
FIG. 10B is an enlarged vertical sectional view of the fixing device shown in FIG. 9 showing a heat generator included therein in a state in which the heat generator is disposed opposite an exciting coil unit but isolated from a fixing belt.
Figure 10C:
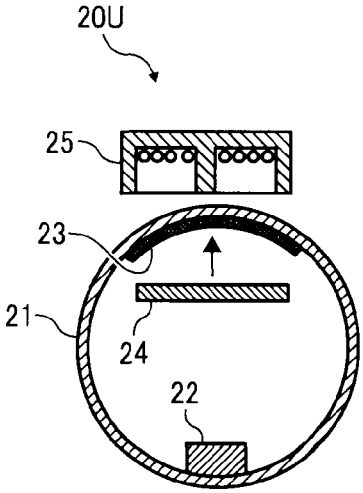
FIG. 10C is an enlarged vertical sectional view of the fixing device shown in FIG. 9 showing a heat generator included therein in a state in which the heat generator is disposed opposite an exciting coil unit and in contact with a fixing belt.

Referring to FIGS. 9, 10A, 10B, and 10C, the following describes a fixing device 20U according to a second illustrative embodiment of the present invention. FIG. 9 is a vertical sectional view of the fixing device 20U. FIGS. 10A, 10B, and 10C illustrate an enlarged vertical sectional view of the fixing device 20U showing movement of the heat generator 23. The fixing device 20U employs the configuration in which a heat generator moving mechanism 27 moves the heat generator 23 but the exciting coil unit 25 is stationary, instead of the configuration of the fixing device 20 depicted in FIG. 5 in which the coil moving mechanism 26 moves the exciting coil unit 25 but the heat generator 23 is stationary.

Similar to the fixing devices 20, 20S, and 20T depicted in FIGS. 2, 7A, and 7B, respectively, according to the first illustrative embodiment, the fixing device 20U according to the second illustrative embodiment, as illustrated in FIG. 9, includes the fixing belt 21, formed into a loop, serving as a fixing rotary body that rotates in the rotation direction R1; the nip formation pad 22, the heat generator 23, and the shield 24, which are disposed inside the loop formed by the fixing belt 21; and the exciting coil unit 25, the pressing roller 31, and the temperature sensor 40, which are disposed outside the loop formed by the fixing belt 21. The pressing roller 31, constructed of the metal core 32 and the elastic layer 33, serves as a pressing rotary body that rotates in the rotation direction R2 counter to the rotation direction R1 of the fixing belt 21; the temperature sensor 40 serves as a temperature detector that detects the temperature of the fixing belt 21.

The fixing device 20U further includes the heat generator moving mechanism 27, instead of the coil moving mechanism 26 of the fixing device 20 depicted in FIG. 5, which moves or rotates the heat generator 23 bidirectionally as indicated by the two-headed arrow in FIG. 9, thus serving as a circumferential moving mechanism or a second moving mechanism that moves the heat generator 23 in the circumferential direction of the fixing belt 21. For example, the heat generator moving mechanism 27 rotates the heat generator 23 clockwise and counterclockwise in FIGS. 10A *and* 10B in the two directions: a direction D4 in which the heat generator 23 rotates to a non-opposed position shown in FIG. 10A where it is not disposed opposite the exciting coil unit 25; and a direction D5 in which the heat generator 23 rotates to an opposed position shown in FIGS. 10B and 10C where it is disposed opposite the exciting coil unit 25. That is, the heat generator moving mechanism 27 moves the heat generator 23 bidirectionally as indicated by the two-headed arrow in FIG. 9 to the two positions: the non-opposed position shown in FIG. 10A where the exciting coil unit 25 heats the first heat generation layer 21*a* depicted in FIG. 3A of the fixing belt 21 only; and the opposed position shown in FIGS. 10B and 10C where the exciting coil unit 25 heats both the first heat generation layer 21*a* of the fixing belt 21 and the second heat generation layer 23*a* depicted in FIG. 3B of the heat generator 23.

Referring to FIG. 9, the following describes the structure of the heat generator moving mechanism 27 that rotates the heat generator 23 as described above.

As illustrated in FIG. 9, the heat generator moving mechanism 27 includes a shaft 27*b* rotatably mounted on each of the flanges provided on the lateral ends of the fixing belt 21 in the axial direction thereof; and a support 27*a* attached to the heat generator 23 and the shaft 27*b*. The shaft 27*b* is mounted with a gear engaging a gear train connected to a driver (e.g., a motor). As the driver rotates the shaft 27*b*, the support 27*a* mounted on the shaft 27*b* rotates the heat generator 23 clockwise or counterclockwise in FIG. 9.

With the configuration described above, similar to the fixing devices 20, 20S, and 20T according to the first illustrative embodiment, the fixing device 20U provides the first heating state and the second heating state.

Specifically, FIG. 10A illustrates the first heating state in which the exciting coil unit 25 heats the first heat generation layer 21*a* depicted in FIG. 3A of the fixing belt 21 only in a state in which the heat generator 23 is at the non-opposed position, not disposed opposite the exciting coil unit 25. FIG. 10C illustrates the second heating state in which the exciting coil unit 25 heats both the first heat generation layer 21*a* of the fixing belt 21 and the second heat generation layer 23*a* depicted in FIG. 3B of the heat generator 23 in a state in which the heat generator 23 is at the opposed position, disposed opposite the exciting coil unit 25.

In addition to the first heating state and the second heating state, the fixing device 20U according to the second illustrative embodiment provides a third heating state shown in FIG. 10B in which the exciting coil unit 25 heats both the first heat generation layer 21*a* of the fixing belt 21 and the second heat generation layer 23*a* of the heat generator 23 in a state in which the heat generator 23 is at the opposed position, disposed opposite the exciting coil unit 25 but isolated from the fixing belt 21 by a separator 28 described below.

Figure 11:
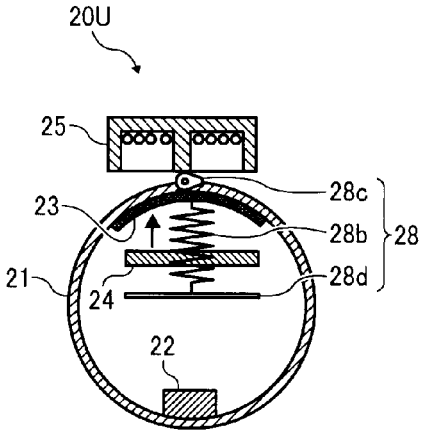
FIG. 11 is an enlarged vertical sectional view of the fixing device shown in FIG. 9 illustrating a separator included therein.

Referring to FIG. 11, the following describes the separator 28 that separates and isolates the heat generator 23 from the fixing belt 21.

FIG. 11 is an enlarged vertical sectional view of the fixing device 20U. As illustrated in FIG. 11, the separator 28 includes a support 28*d* disposed inside the fixing belt 21; a spring 28*b* attached to the heat generator 23 and the support 28*d*; and a cam 28*c* contacting the exciting coil unit 25 and the heat generator 23.

The cam 28*c* is rotatably mounted on each of the flanges provided on the lateral ends of the fixing belt 21 in the axial direction thereof. When the cam 28*c* rotates clockwise in FIG. 11, it lowers the heat generator 23 against a bias applied by the spring 28*b* to the heat generator 23; thus the heat generator 23 moves downward in FIG. 11 to the position shown in FIG. 10B, isolated from the fixing belt 21. Conversely, when the cam 28*c* rotates counterclockwise in FIG. 11 from the position shown in FIG. 10B, it lifts the heat generator 23; thus the heat generator 23 moves upward in FIG. 11 to the position shown in FIG. 10C, contacting the fixing belt 21.

FIG. 10B illustrates the heat generator 23 at the opposed position, disposed opposite the exciting coil unit 25 via the fixing belt 21, and isolated from the fixing belt 21, in the third heating state in which the exciting coil unit 25 heats both the first heat generation layer 21*a* of the fixing belt 21 and the second heat generation layer 23*a* of the heat generator 23. Specifically, in the third heating state, a magnetic flux generated by the exciting coil unit 25 penetrates the first heat generation layer 21*a* of the fixing belt 21 and reaches the second heat generation layer 23*a* of the heat generator 23 isolated from the fixing belt 21. However, since the heat generator 23 is isolated from the fixing belt 21, heat is not transmitted therefrom to the fixing belt 21.

Referring to FIGS. 9, 10A, 10B, 10C, and 11, the following describes movement of the heat generator 23 with the heat generator moving mechanism 27 and the separator 28 described above to switch among the first heating state, the second heating state, and the third heating state.

While the fixing device 20U or the image forming apparatus 1 depicted in FIG. 1 installed with the fixing device 20U is warmed up, the controller 6 depicted in FIG. 1 controls the heat generator moving mechanism 27 to move the heat generator 23 to the non-opposed position shown in FIG. 10A where the heat generator 23 is not disposed opposite the exciting coil unit 25 in the first heating state in which the exciting coil unit 25 heats the first heat generation layer 21*a* depicted in FIG. 3A of the fixing belt 21 only. Thus, even when the image forming apparatus 1 is cool in the morning after it has been powered off for a long time, the fixing belt 21 is heated to a desired fixing temperature quickly because the magnetic flux generated by the exciting coil unit 25 is concentrated on the first heat generation layer 21*a* of the fixing belt 21 only. Moreover, since the heat generator 23 is isolated from the fixing belt 21, it does not draw heat from the fixing belt 21.

By contrast, when a recording medium P bearing a toner image T is conveyed to the nip N formed between the fixing belt 21 and the pressing roller 31, the controller 6 controls the heat generator moving mechanism 27 to move the heat generator 23 from the non-opposed position shown in FIG. 10A to the opposed position shown in FIG. 10B at which the heat generator 23 is disposed opposite the exciting coil unit 25 in the third heating state in which the exciting coil unit 25 heats both the first heat generation layer 21*a* of the fixing belt 21 and the second heat generation layer 23*a* of the heat generator 23. It is to be noted that, in the third heating state, the heat generator 23 is isolated from the fixing belt 21. Namely, immediately after feeding of the recording medium P to the nip N is started, that is, when the fixing belt 21 has been heated to the desired fixing temperature, heat is not transmitted from the heat generator 23 to the fixing belt 21 isolated therefrom.

Thereafter, when the controller 6 determines that the temperature of the fixing belt 21 detected by the temperature sensor 40 is lower than a predetermined temperature, the controller 6 controls the separator 28 to move the heat generator 23 from the position shown in FIG. 10B where it is isolated from the fixing belt 21 to the position shown in FIG. 10C where it contacts the fixing belt 21.

Conversely, when the controller 6 determines that the temperature of the fixing belt 21 detected by the temperature sensor 40 is not lower than the predetermined temperature, the controller 6 controls the separator 28 to move the heat generator 23 from the position shown in FIG. 10C to the position shown in FIG. 10B where it is isolated from the fixing belt 21.

With the above-described control that moves the heat generator 23 from the position shown in FIG. 10B to the position illustrated in FIG. 10C, even when the temperature of the fixing belt 21 is decreased by the recording medium P that draws heat from the fixing belt 21 as it passes over the fixing belt 21 at the nip N, the heat generator 23 contacting the fixing belt 21 heats the fixing belt 21, offsetting the decrease of the temperature of the fixing belt 21 and minimizing formation of a faulty toner image due to the decreased temperature of the fixing belt 21. Conversely, when the temperature of the fixing belt 21 is not decreased, the separator 28 isolates the heat generator 23 from the fixing belt 21; thus the heat generator 23 stores heat generated by the second heat generation layer 23*b* by electromagnetic induction.

It is to be noted that the above-described control can also be performed when a plurality of recording media P is conveyed to the nip N continuously.

With the configuration of the fixing device 20U described above, similar to the configuration of the fixing devices 20, 20S, and 20T shown in FIGS. 2, 7A, and 7B, respectively, it is possible to switch between the first heating state that heats the fixing belt 21 only and the second heating state that heats the fixing belt 21 directly and at the same time heats the fixing belt 21 indirectly via the heat generator 23. Specifically, the heat generator moving mechanism 27 moves the heat generator 23 between the two positions: the non-opposed position shown in FIG. 10A where the heat generator 23 is not disposed opposite the exciting coil unit 25, causing the exciting coil unit 25 to heat the first heat generation layer 21*a* of the fixing belt 21 only by electromagnetic induction in the first heating state; and the opposed position shown in FIG. 10C where the heat generator 23 is disposed opposite the exciting coil unit 25, causing the exciting coil unit 25 to heat both the first heat generation layer 21*a* of the fixing belt 21 and the second heat generation layer 23*a* of the heat generator 23 by electromagnetic induction. Additionally, the separator 28 moves the heat generator 23 to another opposed position shown in FIG. 10B where the heat generator 23 is disposed opposite the exciting coil unit 25, causing the exciting coil unit 25 to heat both the first heat generation layer 21*a* of the fixing belt 21 and the second heat generation layer 23*a* of the heat generator 23 by electromagnetic induction without heat transmission from the heat generator 23 to the fixing belt 21, thus improving heating efficiency for heating the fixing belt 21 by electromagnetic induction and shortening the time to heat the fixing belt 21 to the desired fixing temperature.

In the fixing device 20U according to the second illustrative embodiment described above, the heat generator 23 moves along the inner circumferential surface of the fixing belt 21 between the non-opposed position shown in FIG. 10A corresponding to the first heating state and the opposed position shown in FIGS. 10B and 10C corresponding to the third heating state and the second heating state, respectively. Alternatively, the exciting coil unit 25 disposed outside the loop formed by the fixing belt 21 may move along the outer circumferential surface of the fixing belt 21 as described below to attain effects equivalent to the above-described effects of the fixing device 20U.

Figure 12:
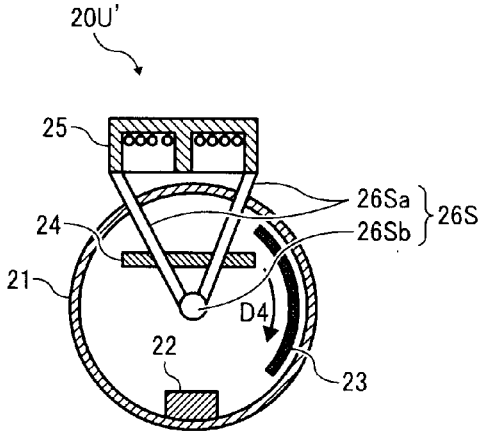
FIG. 12 is a vertical sectional view of one variation of the fixing device shown in FIG. 9 illustrating a coil moving mechanism included therein.

FIG. 12 is a vertical sectional view of a fixing device 20U' including a coil moving mechanism 26S that moves the exciting coil unit 25 disposed outside the fixing belt 21.

As illustrated in FIG. 12, the coil moving mechanism 26S includes a shaft 26Sb rotatably mounted on each of the flanges provided on the lateral ends of the fixing belt 21 in the axial direction thereof; and a support 26Sa attached to the exciting coil unit 25 and the shaft 26Sb. The shaft 26Sb is mounted with a gear engaging a gear train connected to a driver (e.g., a motor). As the driver rotates the shaft 26Sb, the support 26Sa mounted on the shaft 26Sb rotates the exciting coil unit 25 clockwise or counterclockwise in FIG. 12. Thus, the coil moving mechanism 26S serves as a circumferential moving mechanism or a second moving mechanism that moves the exciting coil unit 25 in the circumferential direction of the fixing belt 21.

Figure 13:
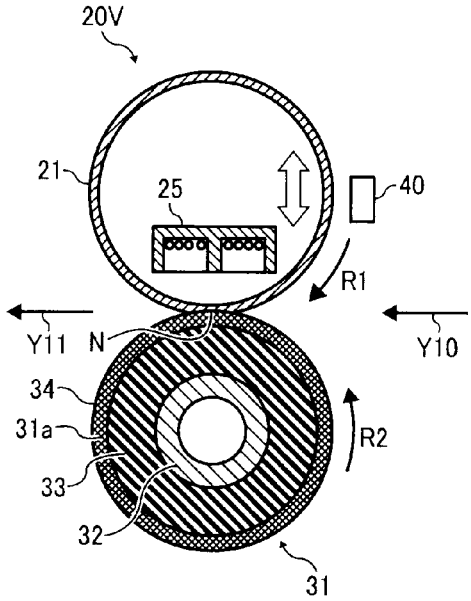
FIG. 13 is a vertical sectional view of a fixing device according to yet another exemplary embodiment of the present invention.

Referring to FIG. 13, the following describes a fixing device 20V according to a third illustrative embodiment of the present invention. FIG. 13 is a vertical sectional view of the fixing device 20V. The fixing device 20V is different from the fixing device 20 depicted in FIG. 2 in that the heat generator is not disposed inside the fixing belt 21.

As illustrated in FIG. 13, the fixing device 20V includes the fixing belt 21, formed into a loop, serving as a fixing rotary body that rotates in the rotation direction R1; the exciting coil unit 25 disposed inside the loop formed by the fixing belt 21; the pressing roller 31, constructed of the metal core 32, the elastic layer 33, a second heat generation layer 31*a*, and a release layer 34 (e.g., a PFA tube), serving as a pressing rotary body that rotates in the rotation direction R2 counter to the rotation direction R1 of the fixing belt 21; and the temperature sensor 40 serving as a temperature detector that detects the temperature of the fixing belt 21. The pressing roller 31 and the temperature sensor 40 are disposed outside the loop formed by the fixing belt 21.

Since the fixing device 20V does not have the heat generator 23 depicted in FIG. 2, the pressing roller 31 includes the second heat generation layer 31*a* that generates heat by electromagnetic induction. Similar to the second heat generation layer 23*a* of the heat generator 23 depicted in FIG. 3B, the second heat generation layer 31*a* of the pressing roller 31 is also made of a conductive material; thus, the pressing roller 31 also serves as a heat generator that generates heat by a magnetic flux generated by the exciting coil unit 25 disposed opposite the pressing roller 31 via the fixing belt 21.

With this configuration of the fixing device 20V, similar to the fixing devices 20, 20S, and 20T depicted in FIGS. 2, 7A, and 7B, respectively, the exciting coil unit 25 moves bidirectionally as indicated by the two-headed arrow in FIG. 13 between the first position where the exciting coil unit 25 is disposed away from the fixing belt 21 and the second position where the exciting coil unit 25 is disposed closer to the fixing belt 21, thus switching between the first heating state in which the exciting coil unit 25 heats the first heat generation layer 21*a* depicted in FIG. 3A of the fixing belt 21 only and the second heat generation state in which the exciting coil unit 25 heats both the first heat generation layer 21*a* of the fixing belt 21 and the second heat generation layer 31*a* of the pressing roller 31.

As a mechanism that moves the exciting coil unit 25 bidirectionally, the fixing device 20V may employ the coil moving mechanism 26' shown in FIG. 8.

Figure 14:
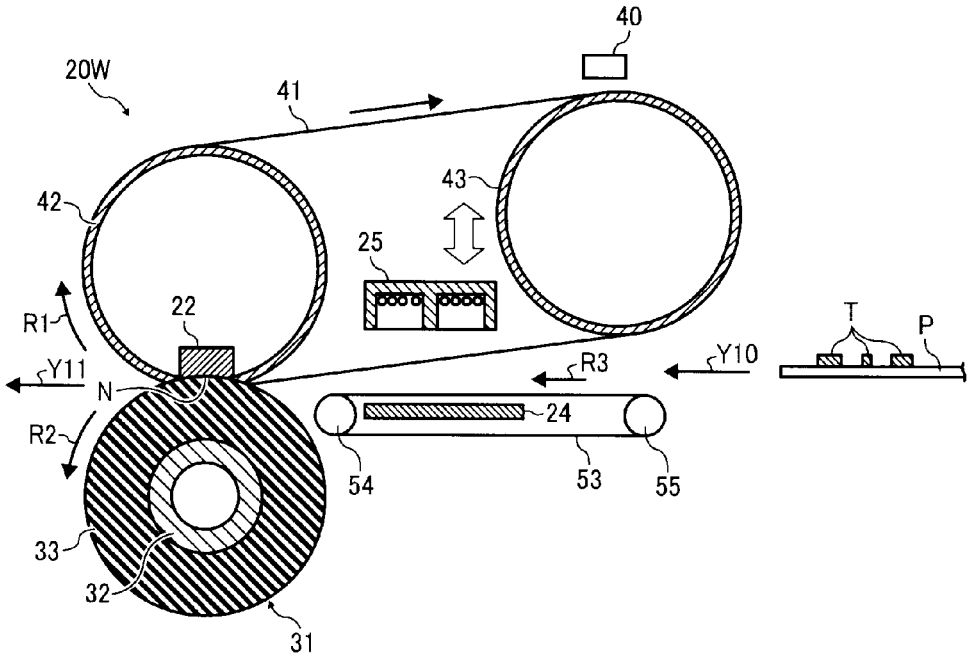
FIG. 14 is a vertical sectional view of a fixing device according to yet another exemplary embodiment of the present invention.
Figure 15A:
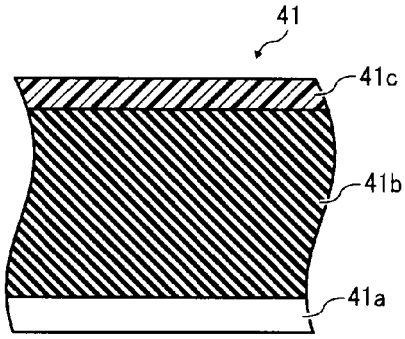
FIG. 15A is a partial vertical sectional view of a fixing belt included in the fixing device shown in FIG. 14.
Figure 15B:
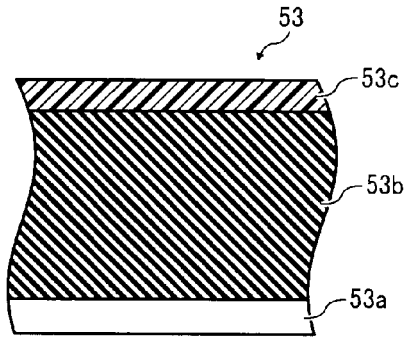
FIG. 15B is a partial vertical sectional view of a conveyance belt included in the fixing device shown in FIG. 14.

Referring to FIGS. 14, 15A, and 15B, the following describes a fixing device 20W according to a fourth illustrative embodiment of the present invention. FIG. 14 is a vertical sectional view of the fixing device 20W. FIG. 15A is a partial vertical sectional view of a fixing belt 41 installed in the fixing device 20W. FIG. 15B is a partial vertical sectional view of a conveyance belt 53 installed in the fixing device 20W.

As illustrated in FIG. 14, the fixing device 20W includes a fixing belt 41, formed into an elliptic loop, serving as a fixing rotary body that rotates in the rotation direction R1; a fixing roller 42, a support roller 43, and the exciting coil unit 25, which are disposed inside the elliptic loop formed by the fixing belt 41; the nip formation pad 22 disposed inside the fixing roller 42; the pressing roller 31, constructed of the metal core 32 and the elastic layer 33, serving as a pressing rotary body that rotates in the rotation direction R2 counter to the rotation direction R1 of the fixing belt 41; the temperature sensor 40 serving as a temperature detector that detects the temperature of the fixing belt 41; a conveyance belt 53, formed into an elliptic loop, which conveys a recording medium P bearing a toner image T toward the nip N formed between the nip formation pad 22 and the pressing roller 31 via the fixing roller 42 and the fixing belt 41; two rollers 54 and 55 that stretch and support the conveyance belt 53; and the shield 24 disposed inside the elliptic loop formed by the conveyance belt 53.

Specifically, the fixing belt 41 is stretched over and supported by the fixing roller 42 and the support roller 43. The pressing roller 31 presses against the nip formation pad 22 via the fixing belt 41 and the fixing roller 42 to foam the nip N between the pressing roller 31 and the fixing belt 41. The conveyance belt 53 is stretched over and supported by the two rollers 54 and 55; the roller 54 drives and rotates the conveyance belt 53 in a rotation direction R3 to feed the recording medium P conveyed in the direction Y10 toward the nip N.

Similar to the fixing belt 21 depicted in FIG. 3A, as illustrated in FIG. 15A, the fixing belt 41 is constructed of multiple layers: a first heat generation layer 41*a* that generates heat by a magnetic flux generated by the exciting coil unit 25 by electromagnetic induction; an elastic layer 41*b* disposed on the first heat generation layer 41*a*; and a release layer 41*c* disposed on the elastic layer 41*b* as an outer layer contacting the recording medium P.

Since the fixing device 20W does not have the heat generator 23 depicted in FIG. 2, the conveyance belt 53 includes a second heat generation layer 53*a* that generates heat by electromagnetic induction as shown in FIG. 15B. Like the fixing belt 21 shown in FIG. 3A, the conveyance belt 53 is constructed of multiple layers: the second heat generation layer 53*a* that generates heat by a magnetic flux generated by the exciting coil unit 25 by electromagnetic induction; an elastic layer 53*b* disposed on the second heat generation layer 53*a*; and a release layer 53*c* disposed on the elastic layer 53*b* as an outer layer contacting the recording medium P.

Similar to the second heat generation layer 23*a* of the heat generator 23 depicted in FIG. 3B, the second heat generation layer 53*a* of the conveyance belt 53 is also made of a conductive material; thus, the conveyance belt 53 serves as a heat generator that generates heat by a magnetic flux generated by the exciting coil unit 25 disposed opposite the conveyance belt 53 via the fixing belt 41.

With this configuration of the fixing device 20W, similar to the fixing devices 20, 20S, and 20T depicted in FIGS. 2, 7A, and 7B, respectively, the exciting coil unit 25 moves bidirectionally as indicated by the two-headed arrow in FIG. 14 between the first position where the exciting coil unit 25 is disposed away from the fixing belt 41 and the second position where the exciting coil unit 25 is disposed closer to the fixing belt 41, thus switching between the first heating state in which the exciting coil unit 25 heats the first heat generation layer 41*a* of the fixing belt 41 only and the second heat generation state in which the exciting coil unit 25 heats both the first heat generation layer 41*a* of the fixing belt 41 and the second heat generation layer 53*a* of the conveyance belt 53.

As a mechanism that moves the exciting coil unit 25 bidirectionally, the fixing device 20W may employ the coil moving mechanism 26' shown in FIG. 8.

With the configuration of the fixing devices 20V and 20W described above, it is possible to switch between the first heating state that heats the fixing belts 21 and 41 only and the second heating state that heats the fixing belts 21 and 41 directly and at the same time heats the fixing belts 21 and 41 indirectly via the pressing roller 31 and the conveyance belt 53.

Specifically, the heat generator moving mechanism 26' depicted in FIG. 8 moves the exciting coil unit 25 between the two positions: the first position where the exciting coil unit 25 is disposed away from the fixing belts 21 and 41, thus heating only the first heat generation layer 21*a* of the fixing belt 21 and the first heat generation layer 41*a* of the fixing belt 41 by electromagnetic induction in the first heating state; and the second position where the exciting coil unit 25 is disposed closer to the fixing belts 21 and 41, thus heating both the first heat generation layer 21*a* of the fixing belt 21 and the second heat generation layer 31*a* of the pressing roller 31 and both the first heat generation layer 41*a* of the fixing belt 41 and the second heat generation layer 53*a* of the conveyance belt 53 by electromagnetic induction, consequently improving heating efficiency for heating the fixing belts 21 and 41 by electromagnetic induction and shortening the time to heat the fixing belts 21 and 41 to the desired fixing temperature.

According to the above-described exemplary embodiments, the fixing belts 21 and 41 are used as a fixing rotary body that rotates in the predetermined direction of rotation; the pressing roller 31 is used as a pressing rotary body disposed opposite the fixing rotary body to form the nip N therebetween and rotating in the direction counter to the direction of rotation of the fixing rotary body. Alternatively, a fixing film, a fixing roller, or the like may be used as a fixing rotary body; a pressing belt or the like may be used as a pressing rotary body, attaining effects equivalent to the effects of the fixing devices according to the above-described exemplary embodiments.

Further, according to the above-described exemplary embodiments, each of the fixing devices 20, 20S, 20T, 20U, 20U', 20V, and 20W depicted in FIGS. 2, 7A, 7B, 9, 12, 13, and 14, respectively, is installed in the monochrome image forming apparatus 1 (depicted in FIG. 1) for forming a monochrome toner image. Alternatively, each of the fixing devices 20, 20S, 20T, 20U, 20U', 20V, and 20W may be installed in a color image forming apparatus for forming a color toner image.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

an endless belt-shaped fixing rotary body including a first heat generation layer;

a pressing rotary body disposed opposite the fixing rotary body to form a nip therebetween through which a recording medium bearing a toner image passes;

a heat generator disposed opposite the fixing rotary body and including a second heat generation layer to heat the fixing rotary body, and the second heat generation layer is configured to be heated above a curie temperature of the second heat generation layer;

an exciting coil unit disposed opposite the heat generator via the fixing rotary body to generate a magnetic flux; and a first moving mechanism connected to one of the heat generator and the exciting coil unit to move the one of the heat generator and the exciting coil unit between a first position where the exciting coil unit is disposed away from the heat generator and a second position where the exciting coil unit is disposed closer to the heat generator, wherein the exciting coil unit generates the magnetic flux so that only the first heat generation layer of the fixing rotary body generates heat by the magnetic flux at the first position to heat the fixing rotary body, and generates the magnetic flux so that both the first heat generation layer of the fixing rotary body and the second heat generation layer of the heat generator generate heat by the magnetic flux at the second position to heat the fixing rotary body, and wherein the heat generator including the second heat generation layer contacts the fixing rotary body including the first heat generation layer.

2. The fixing device according to claim 1, wherein the first moving mechanism moves one of the heat generator and the exciting coil unit in a direction orthogonal to an axial direction of the fixing rotary body to change a distance between the exciting coil unit and the heat generator disposed opposite the exciting coil unit via the fixing rotary body.

3. The fixing device according to claim 1, wherein the first moving mechanism moves the one of the heat generator and the exciting coil unit to the first position when the fixing device is warmed up, and moves the one of the heat generator and the exciting coil unit to the second position when a plurality of recording media passes through the nip.

4. The fixing device according to claim 1, wherein the first heat generation layer of the fixing rotary body is made of a magnetic shunt metal material.

5. The fixing device according to claim 1, wherein the first heat generation layer of the fixing rotary body is made of a non-magnetic metal material.

6. The fixing device according to claim 1, wherein the first heat generation layer of the fixing rotary body has a thickness smaller than a skin depth when an alternating electric current of a predetermined frequency is applied to the exciting coil unit, where the skin depth defines a value obtained based on a resistivity and a magnetic permeability of the first heat generation layer of the fixing rotary body and a frequency of the alternating electric current that excites the first heat generation layer.

7. The fixing device according to claim 1, wherein the second heat generation layer of the heat generator is made of a magnetic shunt metal material.

8. The fixing device according to claim 1, wherein the second heat generation layer of the heat generator is made of a ferromagnetic metal material.

9. A fixing device comprising:

an endless belt-shaped fixing rotary body including a first heat generation layer;

a pressing rotary body disposed opposite the fixing rotary body to form a nip therebetween through which a recording medium bearing a toner image passes;

a heat generator to separably contact the fixing rotary body and including a second heat generation layer, and the second heat generation layer is configured to be heated above a Curie temperature of the second heat generation layer;

an exciting coil unit disposed opposite the heat generator via the fixing rotary body to generate a magnetic flux; and a second moving mechanism connected to one of the heat generator and the exciting coil unit to move the one of the heat generator and the exciting coil unit between a non-opposed position where the heat generator is not disposed opposite the exciting coil unit and an opposed position where the heat generator is disposed opposite the exciting coil unit, wherein the exciting coil unit generates the magnetic flux so that only the first heat generation layer of the fixing rotary body generates heat by the magnetic flux at the non-opposed position to heat the fixing rotary body, and generates the magnetic flux so that both the first heat generation layer of the fixing rotary body and the second heat generation layer of the heat generator generate heat by the magnetic flux at the opposed position to heat the fixing rotary body, and wherein the heat generator including the second heat generation layer contacts the fixing rotary body including the first heat generation layer.

10. The fixing device according to claim 9, wherein the second moving mechanism moves the one of the heat generator and the exciting coil unit in a circumferential direction of the fixing rotary body.

11. The fixing device according to claim 9, wherein the second moving mechanism moves the one of the heat generator and the exciting coil unit to the non-opposed position when the fixing device is warmed up, and moves the one of the heat generator and the exciting coil unit to the opposed position when a plurality of recording media passes through the nip continuously.

12. The fixing device according to claim 11, further comprising:

a temperature detector facing the fixing rotary body to detect a temperature of the fixing rotary body; and a separator connected to the heat generator to separate the heat generator from the fixing rotary body, wherein, when the plurality of recording media passes through the nip continuously, the separator separates the heat generator from the fixing rotary body, and wherein, when the temperature of the fixing rotary body detected by the temperature detector is lower than a predetermined temperature, the separator releases the separation of the heat generator from the fixing rotary body.

13. The fixing device according to claim 9, wherein the first heat generation layer of the fixing rotary body is made of a magnetic shunt metal material.

14. The fixing device according to claim 9, wherein the first heat generation layer of the fixing rotary body is made of a non-magnetic metal material.

15. The fixing device according to claim 9, wherein the first heat generation layer of the fixing rotary body has a thickness smaller than a skin depth when an alternating electric current of a predetermined frequency is applied to the exciting coil unit, where the skin depth defines a value obtained based on a resistivity and a magnetic permeability of the first heat generation layer of the fixing rotary body and a frequency of the alternating electric current that excites the first heat generation layer.

16. The fixing device according to claim 9, wherein the second heat generation layer of the heat generator is made of a magnetic shunt metal material.

17. The fixing device according to claim 9, wherein the second heat generation layer of the heat generator is made of a ferromagnetic metal material.

18. A fixing device comprising:

an endless belt-shaped fixing rotary body including a first heat generation layer;

a pressing rotary body disposed opposite the fixing rotary body to form a nip therebetween through which a recording medium bearing a toner image passes, the pressing rotary body including a second heat generation layer, and the second heat generation layer is configured to be heated above a Curie temperature of the second heat generation layer;

an exciting coil unit disposed opposite the pressing rotary body via the fixing rotary body to generate a magnetic flux; and a coil moving mechanism connected to the exciting coil unit to move the exciting coil unit between a first position where the exciting coil unit is disposed away from the pressing rotary body and a second position where the exciting coil unit is disposed closer to the pressing rotary body, wherein the exciting coil unit generates the magnetic flux so that only the first heat generation layer of the fixing rotary body generates heat by the magnetic flux at the first position to heat the fixing rotary body, and generates the magnetic flux so that both the first heat generation layer of the fixing rotary body and the second heat generation layer of the pressing rotary body generate heat by the magnetic flux at the second position to heat the fixing rotary body, and wherein the pressing rotary body including the second heat generation layer contacts the fixing rotary body including the first heat generation layer.

19. The fixing device according to claim 18, wherein the coil moving mechanism moves the exciting coil unit to the first position when the fixing device is warmed up, and moves the exciting coil unit to the second position when a plurality of recording media passes through the nip continuously.

20. An image forming apparatus comprising the fixing device according to claim 1.

21. The fixing device according to claim 1, wherein the one of the heat generator and the exciting coil unit moves between the first position and the second position while retaining an identical magnetic field produced by the magnetic flux.

22. The fixing device according to claim 1, wherein the pressing rotary body including the second heat generation layer contacts the fixing rotary body including the first heat generation layer to conduct heat to the fixing rotary body.

* * * * *